US008833548B2

(12) United States Patent
Hsieh et al.

(10) Patent No.: US 8,833,548 B2
(45) Date of Patent: Sep. 16, 2014

(54) CONTACT LENS BLISTER PACKAGE

(71) Applicants: Yi-Fan Hsieh, Taipei (TW); Ta-Chih Lin, Kaohsiung (TW)

(72) Inventors: Yi-Fan Hsieh, Taipei (TW); Ta-Chih Lin, Kaohsiung (TW)

( * ) Notice: Subject to any disclaimer, the term of this patent is extended or adjusted under 35 U.S.C. 154(b) by 0 days.

(21) Appl. No.: 13/689,818

(22) Filed: Nov. 30, 2012

(65) Prior Publication Data

US 2014/0001059 A1 Jan. 2, 2014

(30) Foreign Application Priority Data

Jun. 28, 2012 (TW) ..... 101212408 U

(51) Int. Cl.
*A45C 11/04* (2006.01)

(52) U.S. Cl.
USPC ..... 206/5.1; 206/804; 294/1.2

(58) Field of Classification Search
USPC ..... 206/5, 5.1, 205, 210, 223, 461, 466, 206/467, 804; 294/1.2; 134/901
See application file for complete search history.

(56) References Cited

U.S. PATENT DOCUMENTS

| | | | | |
|---|---|---|---|---|
| 5,114,686 | A * | 5/1992 | Gillespie | 422/300 |
| 5,695,049 | A * | 12/1997 | Bauman | 206/5.1 |
| 6,401,915 | B1 * | 6/2002 | Faxe | 206/5.1 |
| 6,471,052 | B2 * | 10/2002 | Faxe et al. | 206/5.1 |
| 2004/0238380 | A1 * | 12/2004 | Newman | 206/5.1 |
| 2009/0139879 | A1 * | 6/2009 | Tokarski et al. | 206/210 |
| 2010/0187140 | A1 * | 7/2010 | Tokarski et al. | 206/216 |

* cited by examiner

*Primary Examiner* — Jacob K Ackun
*Assistant Examiner* — Jenine Pagan
(74) *Attorney, Agent, or Firm* — NDQ International Co., Ltd.

(57) ABSTRACT

An approach is provided for decreasing infection risk and simplifying operation while wearing a contact lens. A contact lens blister package comprises a body. The body has an opening and an inner space where the contact lens is housed. The contact lens has a convex surface that is corresponded to the body opposite from the opening, so that the contact lens is pushed forward to the opening by a finger and the body is turned inside out and transformed to form a protective sheath that is temporarily worn on the finger as the contact lens is placed onto the wearer's eye.

5 Claims, 4 Drawing Sheets

CONTACT LENS BLISTER PACKAGE

FIELD OF THE INVENTION

Embodiments of the invention relate to a package, especially to a contact lens blister package.

BACKGROUND

A conventional contact lens is individually stored in a blister package. There are still many inconvenient disadvantages that exist in the wearing process and an increased risk of eye infections. For example, the contact lens is always removed from the blister package first by either directly grasping it with fingers or indirectly taking out the contact lens with an instrument such as a tweezers. However, the fingers or the instrument might not be sufficiently cleaned and sterilized due to poor hygiene or a lack of adequate cleaning facilities. This is especially true outdoors and it can sometime lead to eye infection or eye discomfort.

Accordingly, contact lens suppliers endeavor to provide a method or a novel package to improve the shortcomings of standard contact lens packaging and application.

SOME EXEMPLARY EMBODIMENTS

These and other needs are addressed by the invention, wherein an approach is provided for improving the usage of a contact lens blister package and decreasing the risk of infection due to inadequate hygiene or insufficient cleaning facilities. The blister package in accordance with the embodiment of the present invention comprises a pliable pack that is transformed to be a protective sheath that avoids direct contact between the fingers and the contact lens that is being applied.

According to one aspect of an embodiment of the invention, a contact lens blister package comprises a body. The body has an opening and an inner space where a contact lens is mounted inside. The contact lens has a convex surface that is corresponded to a side of the body opposite from the opening, so that the body can be turned over to form a protective sheath. The wearer pushes the contact lens forward with their finger as they take it out of the blister pack, prior to placing it on the wearer's eyeball.

Therefore, the contact lens blister package of the invention has a simplified structure, is able to lower manufacturing cost and has advantages of easy use and decreased infection risk.

BRIEF DESCRIPTION OF THE DRAWINGS

The invention is illustrated by way of example, and not by way of limitation, in the figures of the accompanying drawings in which like reference numerals refer to similar elements and in which.

DESCRIPTION OF THE PREFERRED EMBODIMENT

Figure 1:
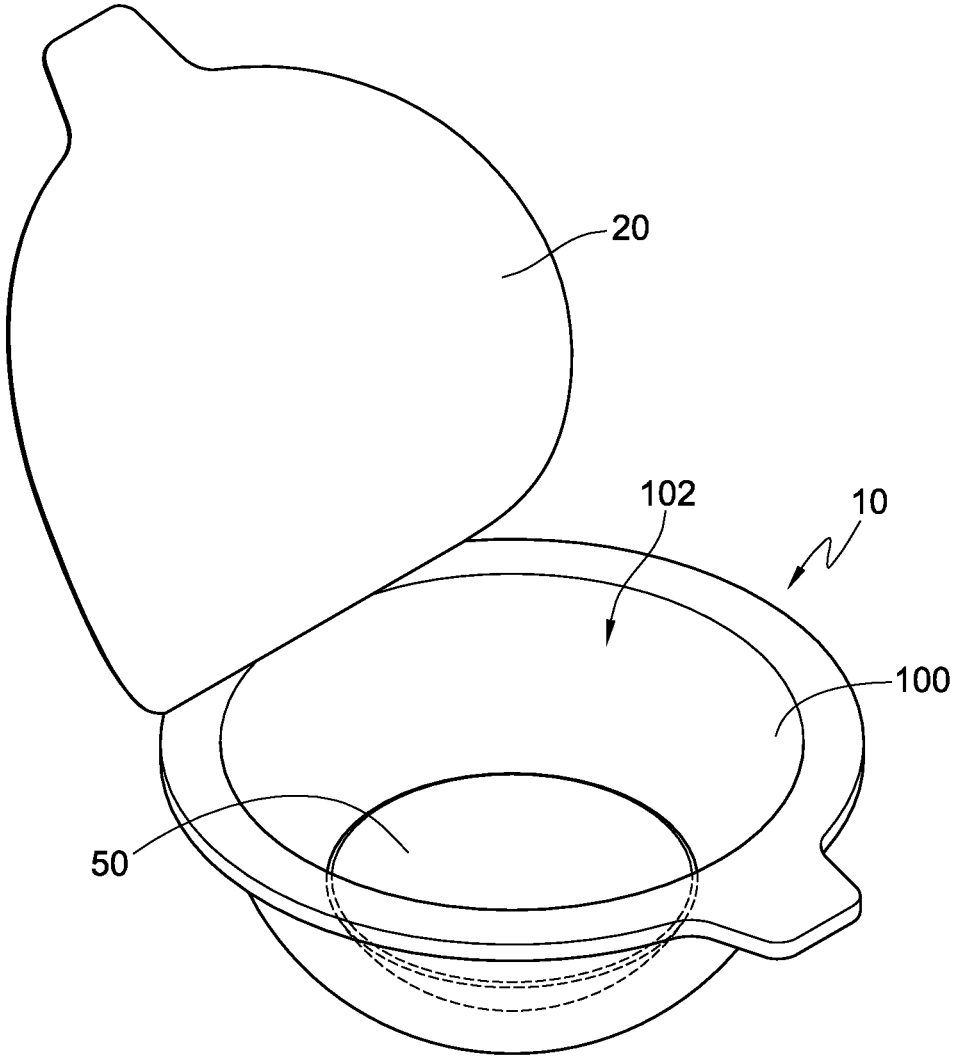
FIG. 1 is a schematic view of an embodiment of a contact lens blister package of the invention.
Figure 2:
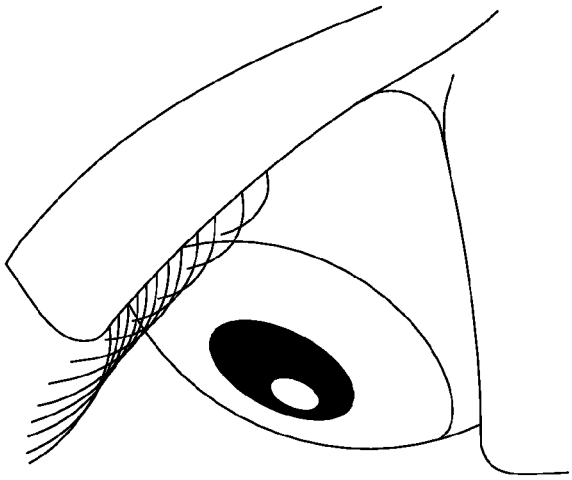
FIG. 2 is a schematic view to illustrate a method to use the contact lens blister package.
Figure 2:
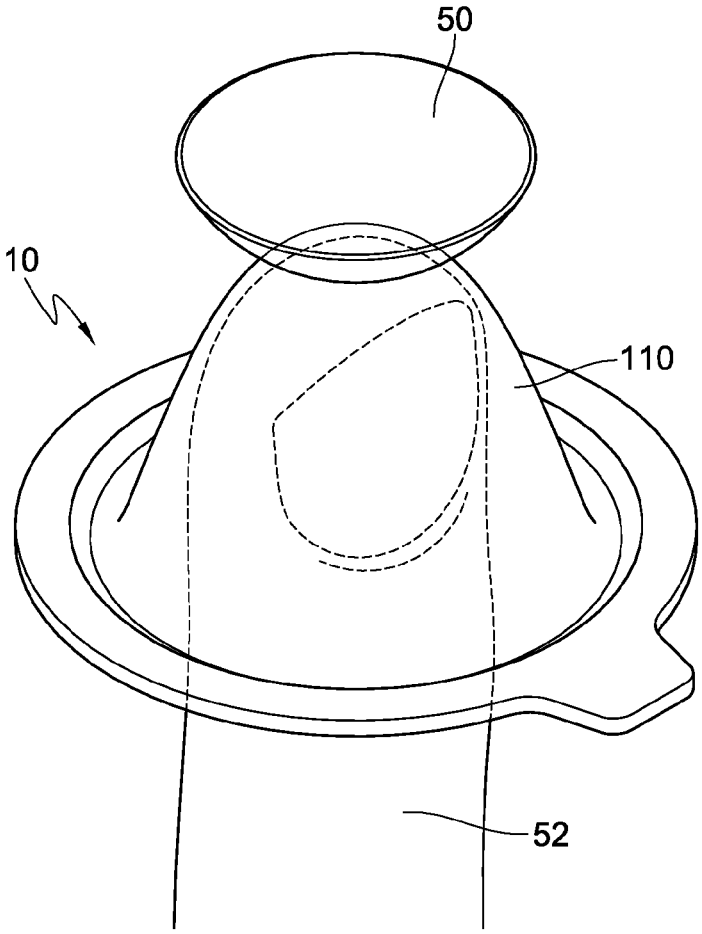

With reference to FIGS. 1 and 2, FIG. 1 is a schematic view of an embodiment of a contact lens blister package of the invention, and FIG. 2 is a schematic view to illustrate a method to use the contact lens blister package of the invention. In this embodiment, the blister package comprises a pliable body 10 and a cover 20. The body 10 comprises an opening 100 and an inner space 102. The inner space 102 is made to contain the contact lens 50 soaked in a sterile solution. The contact lens 50 has a convex surface that is corresponded to the body 10. The side opposite of the contact lens' convex surface is a concave surface that faces toward the opening 100. Accordingly, the contact lens 50 can be moved upward to the opening 100 by a finger pushing the body 10 upward towards the opening 100. As the upward moving finger deforms body 10 it transforms body 10 to form a protective sheath 110. Further upward movement of the protective sheath 110 will remove the contact lens 50 out from the body 10. The cover 20 is placed on an opposite side of the body 10 to seal the opening 100, and may be a waterproof membrane or a plastic film.

In order to wear the contact lens, the cover 20 of the blister package is first removed from (e. g. torn from the cover 20) the body 10 , the contact lens 50 is pushed from the body 10, and lifted upwardly out of the opening 100. In other words, the body 10 is transformed to form the protective sheath 110 to be worn on the finger 52. Therefore, the contact lens is isolated from the finger by the protective sheath 110, avoiding direct contact with the finger and decreasing the risk of infection/discomfort due to bacteria or foreign particles on the wearer's fingers.

Figure 3:
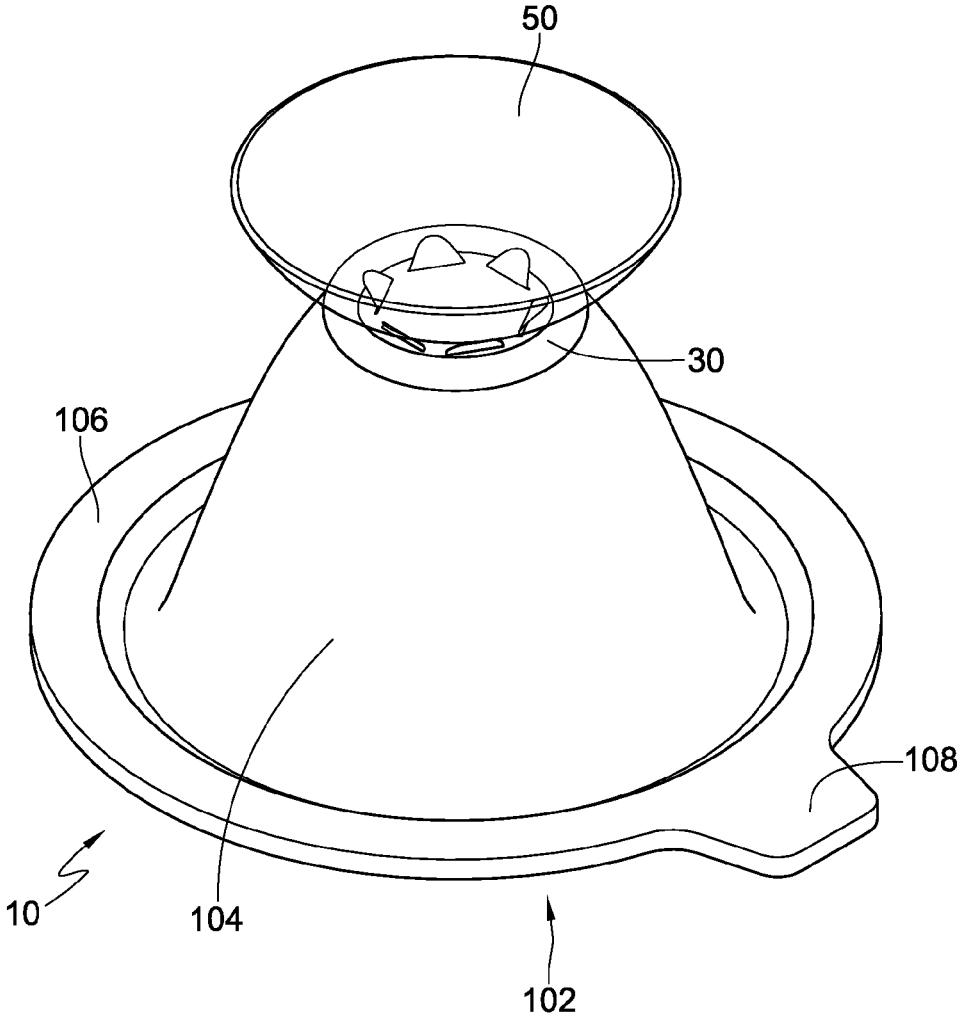
FIG. 3 is a schematic view of the other embodiment of a contact lens blister package of the invention.

With reference to FIG. 3, FIG. 3 is a schematic view of another embodiment of a contact lens blister package of the invention. The contact lens blister pack comprises a body 10. The body 10 further comprises a supple bag 104 with an inner space 102, a ring 106 and a fastener 30. The supple bag 104 is extended downwardly from an inner edge of the ring 106 to form a bag with an upper opening.

As shown in FIG. 3, the contact lens blister package further comprises a cover (not shown) that is tightly attached with the ring 106 by a glue to seal the inner space 102 and to maintain the contact lens blister package in an airtight condition, especially in a vacuum or sterile condition. The supple bag 104 is turned inside out to form a protective sheath to be worn on the finger and to isolate the finger from directly contacting the contact lens. Thus, the contact lens blister package efficiently lowers the risk of infection and the introduction of foreign particles into the eye.

The ring 106 comprises a tab 108. The tab 108 is outwardly extended from an outer edge of the ring 106. The cover 20 is easily torn away by holding the ring 106 and pressing the tab 108 to remove the contact.

The fastener 30 is located on the bag 104 corresponding to the convex surface of the contact lens 50. While the bag 104 is turned inside out to be worn on the finger, a force (e.g. a frictional force) exists between the finger and the fastener 30 of the contact lens blister package which prevents the contact lens blister package from slipping. The fastener 30 of the contact lens blister package is, but is not limited to, a circular-disc with a grainy surface (e.g. composed of tiny particles) or small plastic supports as shown in FIG. 3 thereon, or it may be a disc with an inner concavity.

Figure 4:
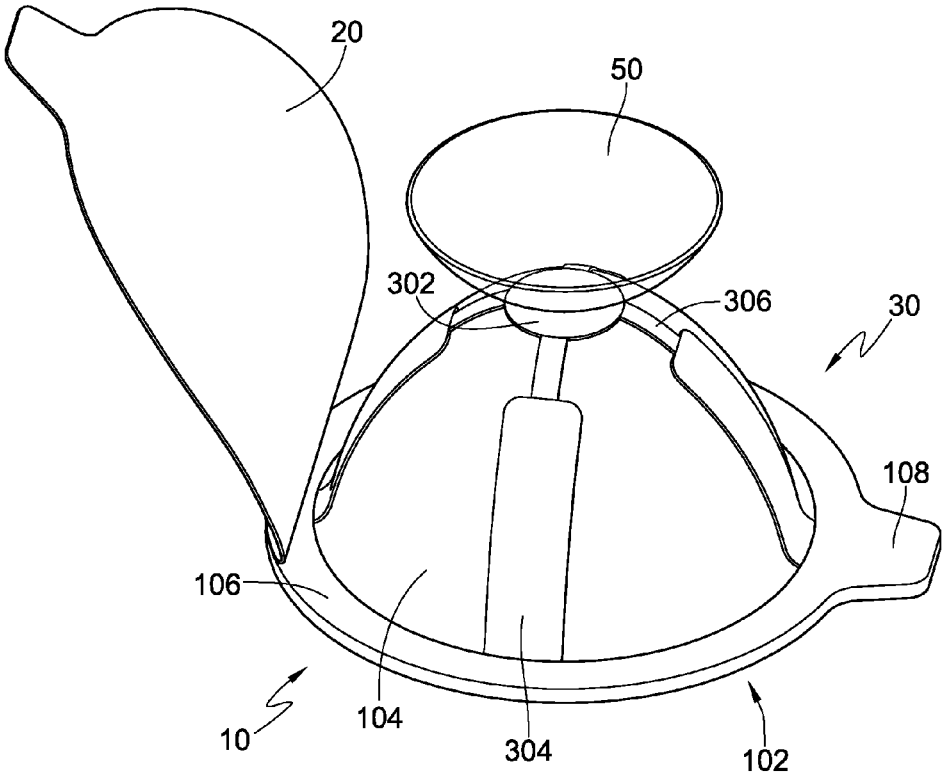
FIG. 4 is a schematic view of another embodiment showing a fastener of the contact lens blister package of the invention.
Figure 5:
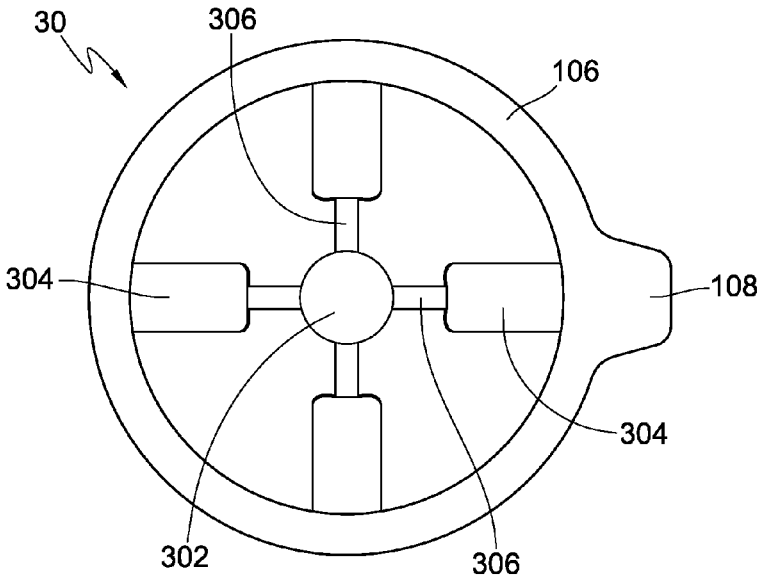
FIG. 5 is a top plan view of the fastener in FIG. 4.

With reference to FIGS. 4 and 5, FIG. 4 is a schematic view of a fastener of the contact lens blister package of another embodiment and FIG. 5 is a top plan view of the fastener in FIG. 4. In this embodiment, the bag 104 of the blister package has been turned over to form a protective sheath. The fastener 30 comprises a blocker 302, at least a set of connecting stripes 306 and at least a set of holders 304. The blocker 302 is located on the bag 104 and corresponds to the convex surface of the contact lens 50. At least a set of connecting stripes 306 is connected to and is radially extended from the blocker 302. Each holder 304 connects a corresponding connecting stripe 306 in series to the blocker 302 and extends along the bag 104 to connect with the ring 106.

With reference to FIG. 5, the fastener 30 comprises two sets of holders 304 and two sets of connecting stripes 306. The holders 304 are cross patterned, connected to the blocker 302 through corresponding connecting stripes 306, and have the capability to be a supporting shell of the bag 104 (refer to FIG. 4) to prevent the bag 104 from damage due to overstress.

In order to wear the contact lens, the ring 106 of the blister package is held by one hand and the bag 104 is deformed by pushing the bag 104, in an area that corresponds to the blocker 302, by a finger of the other hand. The deformation of the supple bag 104 breaks the connecting stripe 306 and allows the bag 104 to be worn on the tip of the finger.

It is should be noted, when the connecting stripe 306 is broken into two segments, a groove is formed between the holders 304 and the blocker 302 which allows a solution inside of the bag 104 to flow. Additionally, one end of the holder 304 is tightly connected to the ring 106, so that the contact lens 50 is stably mounted on the blocker 302 in order to prevent the contact lens 50 slipping off due to flowing solution or inadequate operation.

Accordingly, the contact lens blister package has a simplified structure that corrects the disadvantages of a conventional hard contact lens blister package, and has advantages of lowering infection risks and increasing convenience for the contact lens wearer. The costs of such a structure are low since no additional equipment is needed for contact lens installation on the wearer's eye.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A contact lens blister package comprising:

a body having an opening; a cover being disposed on an opposite side of the body to seal the opening of the body; wherein the body comprises a ring being able to form the opening; and a bar being connected to the ring and being downwardly extended from the ring to form the inner space;

an inner space containing a contact lens, wherein the contact lens having a convex surface that is corresponded to the body opposite from the opening, and the body being turned inside out by a finger to form a protective sheath to lift the contact lens out of the opening; and a fastener having a blocker being disposed on the hag and corresponds to the convex surface of the contact lens;

at least a set of connecting stripes being connected to the blocker; and at least a set of holders being respectively connected to the corresponding connecting stripe and being extended along the bag to connect with the ring.

2. The contact lens blister package as claimed in claim 1, wherein the ring comprises a tab that is outwardly extended from an outer edge of the ring.

3. The contact lens blister package as claimed in claim 1, wherein the body comprises a fastener that is disposed on the bag corresponded to the convex surface of the contact lens.

4. The contact lens blister package as claimed in claim 3, wherein the fastener is a circle-disc with a grainy surface.

5. The contact lens blister package as claimed in claim 1, wherein the cover seals the inner space of the body by a glue.

* * * * *